US011980301B2

(12) United States Patent
Shier

(10) Patent No.: US 11,980,301 B2
(45) Date of Patent: May 14, 2024

(54) MODULAR SYSTEM FOR DISPLAYING SERVICE RIBBONS AND MEDALS

(71) Applicant: Matthew Jared Shier, Mobile, AL (US)

(72) Inventor: Matthew Jared Shier, Mobile, AL (US)

( * ) Notice: Subject to any disclaimer, the term of this patent is extended or adjusted under 35 U.S.C. 154(b) by 206 days.

(21) Appl. No.: 17/699,699

(22) Filed: Mar. 21, 2022

(65) Prior Publication Data

US 2023/0070141 A1 Mar. 9, 2023

Related U.S. Application Data

(60) Provisional application No. 63/241,680, filed on Sep. 8, 2021.

(51) Int. Cl.
*A47F 7/02* (2006.01)
*A44C 3/00* (2006.01)

(52) U.S. Cl.
CPC ..... *A47F 7/02* (2013.01); *A44C 3/002* (2013.01)

(58) Field of Classification Search
CPC ..... A47F 7/02; A44C 3/002
USPC ..... 40/1.5
See application file for complete search history.

(56) References Cited

U.S. PATENT DOCUMENTS

| | | | | |
|---|---|---|---|---|
| 2,795,876 A | | 6/1957 | Hayes | |
| 2,832,161 A | * | 4/1958 | Murphy | A44C 3/002 40/1.5 |
| 3,192,655 A | * | 7/1965 | Harn | A44C 3/002 40/1.5 |
| 3,455,042 A | * | 7/1969 | Carr | A44C 3/002 40/1.5 |
| 3,579,881 A | * | 5/1971 | Cherry | A44C 3/002 40/1.5 |
| 3,942,273 A | | 3/1976 | Adams | |
| 10,004,302 B1 | | 6/2018 | Egger | |

FOREIGN PATENT DOCUMENTS

RU 2667422 C2 * 9/2018

OTHER PUBLICATIONS

Military Ribbon Racks | Build Your Ribbons, Retrieved from Internet, Retrieved on Jan. 13, 2022 <URL: https://www.medalsofamerica.com/military-ribbon-rack-builder>.
Mega Ribbon Kit: 32 RIBBONS—Clear With 1/8" Space, Retrieved from Internet, Retrieved on Jan. 13, 2022 <URL: https://www.vanguardmil.com/products/coast-guard-mega-ribbon-kit-32-ribbons-8539>.

* cited by examiner

*Primary Examiner* — Cassandra Davis

(57) ABSTRACT

The present invention provides a modular ribbon rack device that comprises a plurality of ribbon rack bars, a plurality of magnetic connectors connected to the ribbon rack bars and a ribbon bar backplate attached to the magnetic connectors. The magnetic connectors include an external plastic housing having a grooved cavity and at least one extruded notch.

20 Claims, 10 Drawing Sheets

MODULAR SYSTEM FOR DISPLAYING SERVICE RIBBONS AND MEDALS

FIELD OF THE INVENTION

The present invention relates generally to a holder for military ribbons. More specifically, the present invention relates to ribbon racks with an elongated channel-shaped structure.

BACKGROUND OF THE INVENTION

Ribbon racks designed to hold military ribbons of various sizes are in demand. Military ribbons, ribbon bars, and medals are worn on uniforms to indicate the military service and personal accomplishments of the individual wearing the ribbons. For example, the ribbons may represent personal decorations, participation in various campaigns, unit awards, service awards, or the like.

Standard military campaign ribbons are fabricated according to relatively lenient tolerances, and consequently, ribbons racks tend to fluctuate in size. When a person wears several rows of ribbons, the size of the ribbon rack needs to be adjusted.

Currently, available mounting devices for ribbons are not adjustable to hold varying amounts of military ribbons. Military ribbon holders on the market do not have the configuration to permit adjusting the size. In addition, current military ribbon racks do not include a ribbon pin clasp that tightens the rack to the article of clothing to prevent a gap and sagging ribbon rack. A new rack must be purchased every time a new ribbon is earned because of the size variance. Ribbon racks come in almost 900 different shapes and configurations, and their sizes are not adjustable.

Thus, there is a need to improve these ribbon racks by addressing the aforementioned problems. The present invention aims to solve the problems associated with the conventional ribbon rack device through an innovative design and configuration of a ribbon rack, providing a modular system where users can purchase a ribbon rack set or pieces of a ribbon rack set that can be added to and removed from itself, in essence building custom ribbon racks to accommodate the user's amount of ribbons.

SUMMARY

In accordance with the present invention, a modular ribbon rack device is provided. The modular ribbon rack device comprises a plurality of ribbon rack bars, a plurality of magnetic connectors connected to the ribbon rack bars and a ribbon bar backplate attached to the magnetic connectors. The magnetic connectors include an external plastic housing having a grooved cavity and at least one extruded notch.

In one embodiment, the external plastic housing of the magnetic connectors can include a tongue and groove mechanism attach a magnet.

In some embodiments, the ribbon bar backplate may include a middle rectangular portion, left rectangular portion and right rectangular portion, wherein the middle rectangular portion is larger than the left rectangular portion and the right rectangular portion.

In some embodiments, the present invention may include a ribbon bar backplate that is an elongated bar.

In some embodiments, one or more modular ribbon rack devices of the present invention can be assembled or combined securely together using the magnetic connectors by connecting the ribbon rack backplates.

The rubber clasp is included in the present invention to allow for no gap or sagging of the ribbons.

DETAIL DESCRIPTIONS OF THE INVENTION

Figure 1:
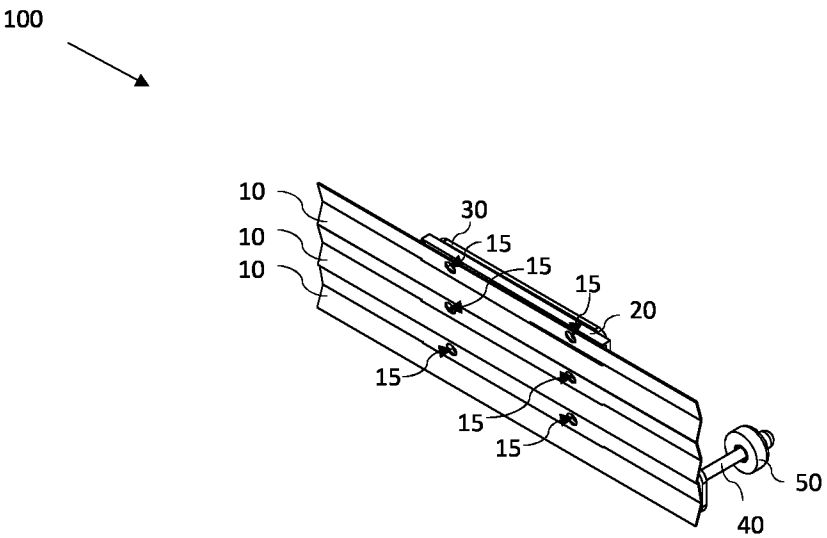
FIG. 1 is an illustration of one embodiment of the present invention.
Figure 2:
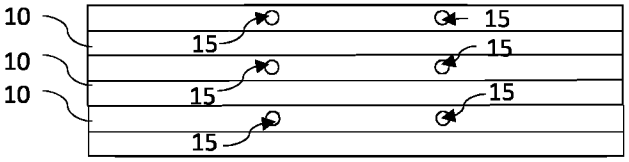
FIG. 2 is a front view of one embodiment of the present invention.
Figure 3:
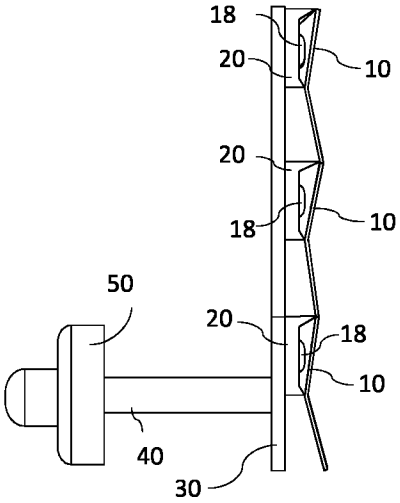
FIG. 3 is a side view of one embodiment of the present invention.
Figure 4:
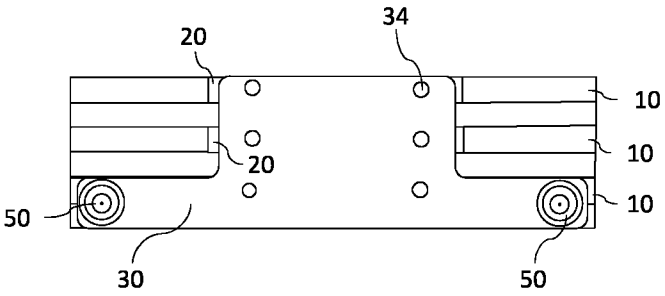
FIG. 4 is a back view of one embodiment of the present invention.
Figure 5:
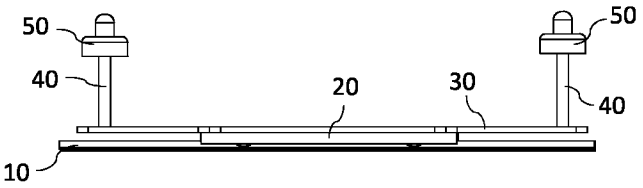
FIG. 5 is a top view of one embodiment of the present invention.
Figure 6:
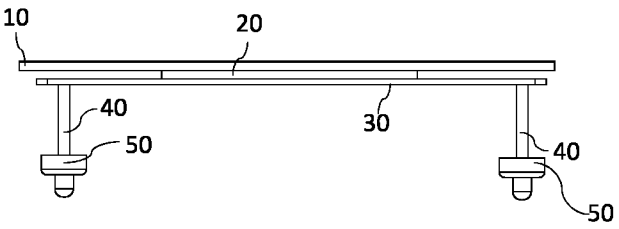
FIG. 6 is a bottom view of one embodiment of the present invention.

All illustrations of the drawings are for the purpose of describing selected versions of the present invention and are not intended to limit the scope of the present invention.

The present invention provides a ribbon rack configured and modularized so that users can purchase a large ribbon rack or a set of racks to build custom ribbon racks for various ribbon sizes. The ribbon rack sizes are easily adjustable by adding or removing ribbon rack pieces.

As shown in FIGS. 1 to 6 and FIG. 9, the present invention provides a modular ribbon rack device 100 made up of a plurality of ribbon rack bars 10, a plurality of magnetic connectors 20, a ribbon bar backplate 30, and a plurality of rubber clasps 50. The backplate 30 may be attached to an article of clothing, such as a service uniform by using the fastening pin and clasp, followed by snapping the magnetic connector 20 and ribbon bar 10 in place and applying ribbons.

For example, the ribbon rack bar 10 can be attached to the magnetic connector 20 via a snap attachment. The magnetic connector 20 may also be snapped or otherwise affixed or attached to the ribbon bar backplate 30, without affecting the scope of the present invention.

In one embodiment, the ribbon rack bar 10 and the magnetic connector 20 and/or the magnetic connector 20 and the ribbon bar backplate 30 can be attached together by any other fasteners known in the art.

In some embodiments, the ribbon rack bar 10, the magnetic connector 20, and the ribbon bar backplate 30 may include a mechanical fastener, such as a screw or other fastener, or a snap type connection or the like to attach to each other.

Figure 7:
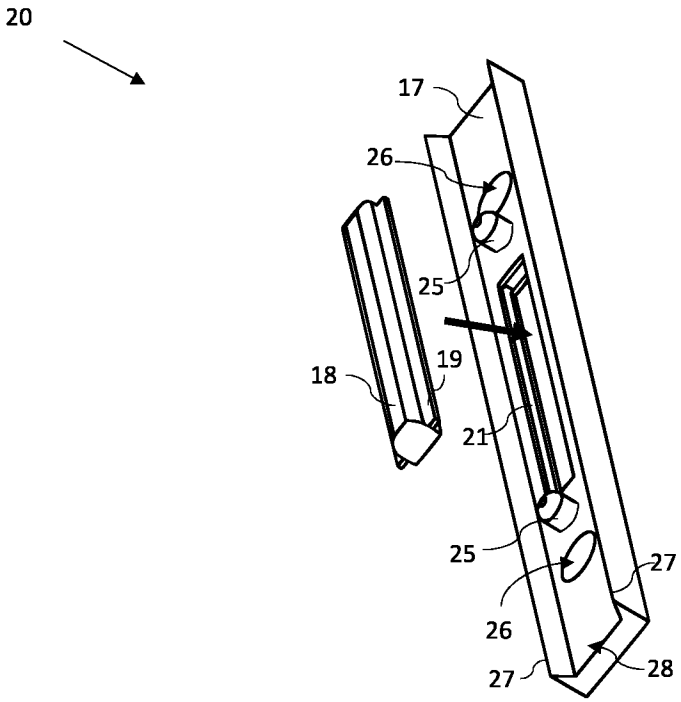
FIG. 7 is an illustration of one embodiment of a magnetic connector of the present invention.

In some embodiments, the ribbon rack bar 10 may include a plurality of holes 15 and, as shown in FIG. 7, the magnetic connector 20 may include a plurality of mating pins 25 to allow snap attachment of the ribbon rack bar 10 and the magnetic connector 20. In some embodiments, the magnetic connector 20 may include a plurality of connector holes 26 that can be used to attach the magnetic connector 20 to the ribbon bar backplate 30 by fasteners known in the art.

The ribbon bars 10 may be in any shape and of suitable size to accommodate a ribbon or ribbons. The ribbon bar backplates 30 vary in shapes and sizes as well to accommodate the rows of ribbons.

The magnetic connector 20 can be used to magnetically connect the various ribbon bar 10 sizes to the various ribbon bar backplates 30.

In one embodiment, as shown in FIG. 7, the magnetic connector 10 can be include an external plastic housing 17, which has a magnet 18 inserted into the external plastic housing using a tongue and groove mechanism to allow for the switchable coupling of the magnet 18.

In some embodiments, the tongue 19 can be attached to the magnet 18 and the groove 21 can be included in the external plastic housing 17, wherein the groove 21 is made to fit the tongue 19 and fits snuggly when the magnet 18 is pressed unto the external plastic housing 17.

The front of the magnetic connector 20 includes a grooved cavity 28 and extruded notches 27 for the ribbons bars to fit at the proper angle and center together. The back of the magnetic connector 20 has more of a flat profile. This method provides means to secure the ribbon rack bars 10 to the ribbon bar backplates 30 properly together and centered to their left and right, allowing for the ribbons to slide easily onto the ribbon rack bars 10 bars and be displayed in a uniformed and centered manner.

The current method of pinning ribbon racks to the uniform utilizes a traditional brass clasp and pin, allowing for a large gap and sagging ribbons to be made between the uniform and ribbon rack assembly. The rubber clasp 50 in the present invention (shown in FIGS. 3 to 6) presses firmly onto the pins 40 (that can be attached to the ribbon bar backplates 30) until the rubber clasp 50 is tightly connected against the uniform allowing for no gap or sagging of the ribbons and ribbon rack assembly (which can be one or more modular ribbon rack devices 100), but this does not limit the scope of how the pins 40 can be secured to the uniform. The modular ribbon rack assembly (one or more modular ribbon rack devices 100) may be secured to articles of clothing with any other mechanisms in several different ways.

The modular ribbon rack devices 100 may be formed from any suitable material including but not limited to brass, copper, steel, a composite, a plastic or the like, and may be formed through any suitable manufacturing process, such as stamping, forging, machining, molding, or the like.

Figure 8:
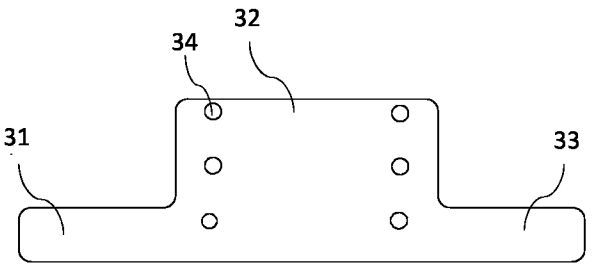
FIG. 8 is an illustration of one embodiment of a ribbon bar backplate of the present invention.
Figure 9:
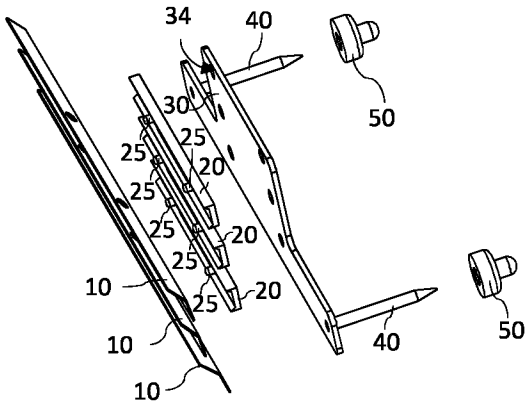
FIG. 9 is an exploded view of one embodiment of the present invention.

In one embodiment, as shown in FIG. 8, the ribbon bar backplate 30 may include a plurality of backplate holes 34, a middle rectangular 32 portion, left rectangular portion 31 and right rectangular portion 33. The middle rectangular portion 32 can be larger than the left rectangular portion 31 and the right rectangular portion 33.

In some embodiments, the ribbon bar backplate 30 may be an elongated bar (with the middle rectangular portion 32 having substantially the same size as the left rectangular portion 31 and the right rectangular portion 33) and may include a plurality of backplate holes 34.

In some embodiments, the ribbon rack backplate 30 may be mounted against an article of clothing using any magnets known in the art. For example, the ribbon rack backplate 30 may be manufactured without pins 40 attached, thus leaving the ribbon rack backplate 30 with a flatter profile to accommodate one or more magnets. This embodiment with flatter profile may allow for the present invention to be more flatly pressed against the article of clothing and allows connection of any size or number of magnets. Various magnet options are possible, along with acceptable forces that will feel sturdy.

Figure 10:
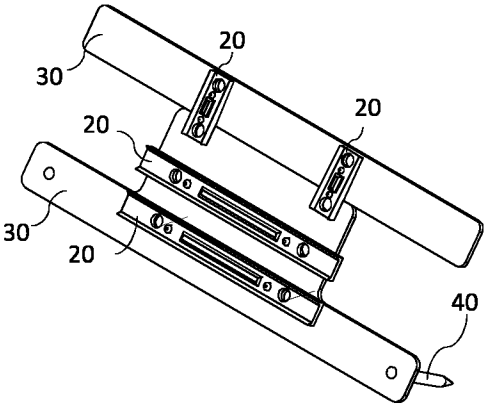
FIG. 10 is an illustration of one embodiment of the present invention with two ribbon bar backplates combined together by magnetic connectors.

In some embodiments, as shown in FIG. 10, one or more modular ribbon rack devices 100 can be assembled or combined securely together using magnetic connectors 20 by connecting various sized ribbon rack backplates 30 where various sized ribbon rack bars 10 can be attached.

In some other embodiments, the ribbon bars 10, magnetic connectors 20, and ribbon rack backplate 30 may have a slight curvature to give the present invention a lower profile and to allow the present invention to fit the user and article of clothing in a more comfortable manner.

Although the invention has been explained in relation to its preferred embodiment, it is to be understood that many other possible modifications and variations can be made without departing from the spirit and scope of the invention.

What is claimed is:

1. A modular ribbon rack device comprising:

a plurality of ribbon rack bars having an elongated surface with plurality of holes;

a plurality of magnetic connectors connected to the plurality of ribbon rack bars, the plurality of magnetic connectors include:

an external plastic housing having a plurality of mating pins, a grooved cavity and at least one extruded notch;

a magnet inserted into the plastic housing using a tongue and groove mechanism; and a ribbon bar backplate attached to the magnetic connectors, the ribbon bar backplate having a plurality of backplate holes, a middle rectangular portion, left rectangular portion and right rectangular portion, wherein the middle rectangular portion is larger than the left rectangular portion and the right rectangular portion.

2. The modular ribbon rack device as claimed in claim 1, wherein the plurality of ribbon rack bars include a V-shaped surface.

3. The modular ribbon rack device as claimed in claim 1, wherein the ribbon bar backplate includes a plurality of elongated pins attached to the ribbon bar backplate.

4. The modular ribbon rack device as claimed in claim 3, wherein the modular ribbon rack device includes a plurality of clasps removably connected to the elongated pins.

5. A modular ribbon rack device comprising:

a plurality of ribbon rack bars having an elongated surface; and a plurality of magnetic connectors connected to the plurality of ribbon rack bars, the plurality of magnetic connectors include:

an external plastic housing having a grooved cavity and at least one extruded notch;

a magnet inserted into the plastic housing using a tongue and groove mechanism;

a ribbon bar backplate attached to the magnetic connectors, the ribbon bar backplate having a plurality of backplate holes, a middle rectangular portion, left rectangular portion and right rectangular portion, wherein the middle rectangular portion is larger than the left rectangular portion and the right rectangular portion.

6. The modular ribbon rack device as claimed in claim 5, wherein the plurality of ribbon rack bars includes a V-shaped surface.

7. The modular ribbon rack device as claimed in claim 5, wherein the ribbon bar backplate includes a plurality of elongated pins attached to the ribbon bar backplate.

8. The modular ribbon rack device as claimed in claim 7, wherein the modular ribbon rack device includes a plurality of clasps removably connected to the elongated pins.

9. A modular ribbon rack device comprising:

a plurality of ribbon rack bars having an elongated surface with plurality of holes;

a plurality of magnetic connectors connected to the plurality of ribbon rack bars, the plurality of magnetic connectors include:

an external plastic housing having a plurality of mating pins, a grooved cavity and at least one extruded notch;

a magnet inserted into the plastic housing using a tongue and groove mechanism; and a ribbon bar backplate attached to the magnetic connectors, the ribbon bar backplate is an elongated bar having a plurality of backplate holes.

10. The modular ribbon rack device as claimed in claim 9, wherein the plurality of ribbon rack bars include a V-shaped surface.

11. The modular ribbon rack device as claimed in claim 9, wherein the ribbon bar backplate includes a plurality of elongated pins.

12. The modular ribbon rack device as claimed in claim 11, wherein the modular ribbon rack device includes a plurality of clasps removably connected to the elongated pins.

13. A modular ribbon rack device comprising:

a plurality of ribbon rack bars having an elongated surface with plurality of holes;

a plurality of magnetic connectors connected to the plurality of ribbon rack bars, the plurality of magnetic connectors include:

an external plastic housing having a plurality of mating pins, a grooved cavity and at least one extruded notch;

a magnet inserted into the plastic housing using a tongue and groove mechanism; and at least two ribbon bar backplates attached to the magnetic connectors, the at least two ribbon bar backplates are attached together.

14. The modular ribbon rack device as claimed in claim 13, wherein the plurality of ribbon rack bars include a V-shaped surface.

15. The modular ribbon rack device as claimed in claim 13, wherein the ribbon bar backplate includes a plurality of elongated pins attached to the at least two ribbon bar backplates.

16. The modular ribbon rack device as claimed in claim 15, wherein the modular ribbon rack device includes a plurality of clasps removably connected to the elongated pins.

17. A modular ribbon rack device comprising:

a plurality of ribbon rack bars having an elongated surface; and a plurality of magnetic connectors connected to the plurality of ribbon rack bars, the plurality of magnetic connectors include:

an external plastic housing having a grooved cavity and at least one extruded notch;

a magnet inserted into the plastic housing using a tongue and groove mechanism;

at least two ribbon bar backplates attached to the magnetic connectors, the at least two ribbon bar backplates having a plurality of backplates holes, a middle rectangular portion, left rectangular portion and right rectangular portion, wherein the middle rectangular portion is larger than the left rectangular portion and the right rectangular portion.

18. The modular ribbon rack device as claimed in claim 17, wherein the modular ribbon rack device includes a plurality of elongated pins attached to the at least two ribbon bar backplates.

19. The modular ribbon rack device as claimed in claim 18, wherein the modular ribbon rack device includes a plurality of clasps removably connected to the elongated pins.

20. The modular ribbon rack device as claimed in claim 17, wherein the plurality of ribbon rack bars include a V-shaped surface.

* * * * *